US005096218A

United States Patent [19]

Bardin

[11] Patent Number: 5,096,218

[45] Date of Patent: Mar. 17, 1992

[54] SAFETY SKI BINDING

[75] Inventor: Roland Bardin, Varennes-Vauzelles, France

[73] Assignee: Look S.A, Nevers, France

[21] Appl. No.: 513,632

[22] Filed: Apr. 24, 1990

[30] Foreign Application Priority Data

Apr. 25, 1989 [EP] European Pat. Off. ..... 89107470

[51] Int. Cl.[5] ..... A63C 9/08

[52] U.S. Cl. ..... 280/633

[58] Field of Search ..... 280/623, 633, 634, 611

[56] References Cited

U.S. PATENT DOCUMENTS 4,620,719 11/1986 Stritzl ..... 280/633
4,690,424 9/1987 Spitaler et al. ..... 280/633
4,699,398 10/1987 Luschnig et al. ..... 280/633

FOREIGN PATENT DOCUMENTS 3015478 11/1980 Fed. Rep. of Germany ..... 280/633

*Primary Examiner*—Andres Kashnikow

*Assistant Examiner*—Michael Mar

*Attorney, Agent, or Firm*—Townsend and Townsend

[57] ABSTRACT

A safety ski binding comprises a releasable front jaw (11) engaging one end of the ski boot (15) and a heel jaw (12) which engages a second end of the ski boot (15). A heel jaw housing (16) is mounted longitudinally displaceably in longitudinal guides (13) affixed to the ski. Preferably, there is at least some vertical and horizontal play between heel jaw housing (16) and longitudinal guides (13). Heel jaw housing (16) is urged by at least one thrust spring (14) against the ski boot (15) which bears on the one side on heel jaw housing (16) and on the other side on a longitudinally adjustable lock member (18) which is also affixed to the ski. Between the end of the thrust spring (14) bearing on the lock member (18) and the lock member (18), a force-resolving means (20), which resolves a part of the longitudinal force (F) of the thrust spring (14) into two opposite spreading forces (S), is disposed. Spreading forces (S) act on lock member (18) in the direction of the ski (21) and on heel jaw housing (16) in the direction away from the ski.

10 Claims, 13 Drawing Sheets

SAFETY SKI BINDING

BACKGROUND AND SUMMARY OF THE INVENTION

The invention relates to a safety ski binding comprising a releasable holding jaw, in particular front jaw, engaging one end of the ski boot and a counter jaw, in particular heel jaw, engaging the other end of the ski boot.

In a known safety ski binding of this type (DE-PS 3,015,478) provision is made for the resilient biasing between the lock member and the heel jaw housing to be present only in the rest position with the ski boot not inserted whilst said biasing, when the binding is attached is automatically cancelled in dependence upon a longitudinal displacement of the counter jaw housing in the longitudinal guide against the action of the thrust spring. The purpose of providing the resilient biasing only in the rest position is to avoid rattling of the binding during transport caused by play in the longitudinal guides whilst the play should be present when the ski boot is inserted in order to obstruct as little as possible the resilient relative movement of the counter jaw housing in the longitudinal guide when the binding is in use.

In such safety ski bindings the purpose of the thrust spring is of course to compensate spacing changes of the front and heel jaws on bending of the ski. If for example when passing through a trough the ski bends to a greater extent the distance between the front and heel jaws would change. In such a case the heel jaw may be displaced somewhat against the force of the thrust spring so that a constant distance is ensured between the two jaws of the safety ski binding.

However, the thrust spring also has a disadvantageous effect on the safety behaviour of the binding. The greater the thrust spring is compressed, which depends not only on the bending of the ski but also on the size of the inserted ski boot or on snow and ice intermediate layers, the greater the forwardly directed longitudinal force exerted by the thrust spring via the heel jaw and the ski boot on the front jaw. Since generally this longitudinal force influences the release behaviour of the preferably laterally, possibly also however upwardly, releasable front jaw considerably in the sense of making said release more difficult with increased longitudinal force, the aim will be to keep the thrust force as low as possible. However, to ensure reliable holding of the boot between front and heel jaws under all operating and weather conditions this force must not drop below a predetermined value.

The objective of the present invention is now to provide a safety ski binding of the type mentioned at the beginning in which the increase of the thrust force with increasingly compressed thrust spring no longer increases corresponding to the thereby increasing spring force but only to an appreciably lesser degree or even not at all.

The idea underlying the invention is also to be seen in that in each position of the heel jaw, i.e. in particular in all displacement positions during use of the binding with the ski boot inserted, the spreading force between the lock member and the heel jaw housing is derived from the thrust spring and is preferably proportional thereto. Accordingly, the clamping forces between the heel jaw housing and the longitudinal guides increase with increasing compression of the thrust spring and the frictional forces acting within the longitudinal guides thus also increase. These frictional forces in turn reduce the thrust force acting on the ski boot so that the objective of limiting the rise of the thrust force with increasing compression of the thrust spring or preventing said rise is achieved in extremely simple manner with minimum constructional expenditure. A further pushing back of the heel jaw under relatively large bending of the ski is not prevented by the increased frictional force within the longitudinal guides because the forces at the jaws of the safety ski binding produced by bending of the ski are so large that the frictional forces and the force of the thrust spring are negligible compared therewith.

In safety ski bindings operating with thrust spring there is always the problem of being able to insert the heel jaw axially to various boot sizes by temporary releasing of the lock member from the ski. Various solutions of how, by hand or by means of a tool, simultaneously the lock member can be released from the ski and the heel jaw housing can be shifted longitudinally into the desired position are provided. These solutions are also of significance independently of the spreading force generation according to the invention.

DESCRIPTION OF THE DRAWINGS

The invention will be described hereinafter by way of example with the aid of the drawings, wherein.

DETAILED DESCRIPTION

Figure 1:
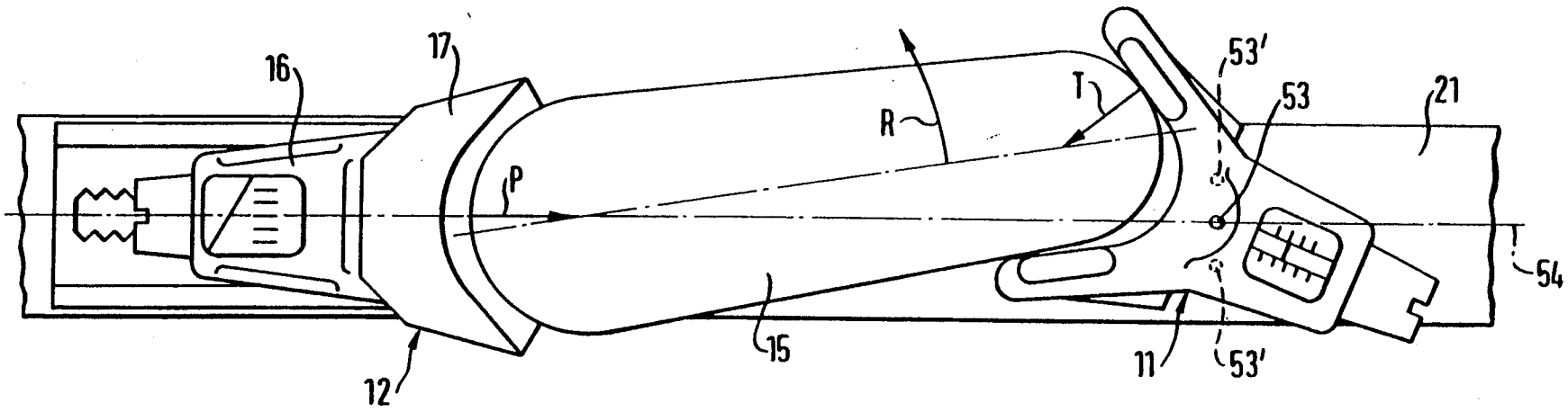
FIG. 1 is a schematic plan view of a ski equipped with a safety ski binding according to the preamble.

According to FIG. 1 a front jaw 11 and a heel jaw 12 having a binding housing 16 and a sole holder 17 attached upwardly pivotally thereto are mounted on the surface of a ski 21. The front jaw 11 is pivotal laterally about a vertical axis 53 against a resilient release force to free the ski boot 15 inserted between the front jaw 11 and the heel jaw 12 when excessive torsional forces act on the leg of the skier. The ski boot 15 then pivots in the direction of the arrow R or in the opposite direction laterally outwardly and is finally completely freed from the ski 21.

The heel jaw 12 is mounted on the ski 21 displaceably longitudinally of said ski in the direction of the front jaw 11 and is biased by a thrust spring 14, explained with reference to the further examples of embodiment and not shown in FIG. 1, in the direction towards the front jaw 11 so that a longitudinal force P is exerted on the ski boot and counteracts the return force T of the front jaw 11 undergoing the lateral release movement..

In the stage of the lateral release movement illustrated in FIG. 1 the thrust force P assists the lateral release of the front jaw 11. However, in the rest position with the front jaw 11 not yet laterally released the thrust force P acts against the lateral release, particularly when, as with, tilt jaws, instead of a central vertical pivot pin 53 two vertical pivot pins 53' are provided on either side of the central longitudinal axis 54.

The release behaviour of the front jaw 11 is thus differently influenced depending on the magnitude of the thrust force P.

In the following examples of embodiment of heel jaws constructed according to the invention the variable influence of the thrust force P on the release behaviour of the binding is considerably reduced and can even be completely eliminated.

Figure 2:
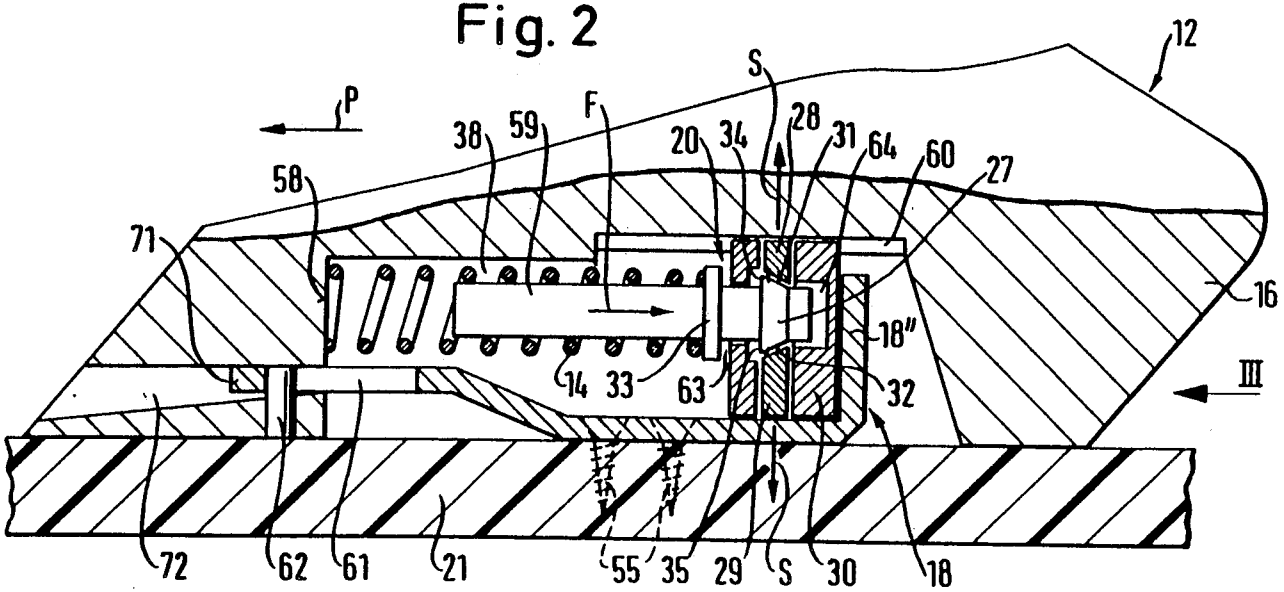
FIG. 2 is a schematic partially sectioned partial side view of a first embodiment of a heel jaw according to the invention.

FIG. 2 shows an only partially illustrated heel jaw 12 which in use exerts the thrust force P on the ski boot (15 in FIG. 1) which is not illustrated and in the position of FIG. 2 also not inserted into the binding. By only schematically indicated securing means 55, a lock member 18 is secured to the surface of the ski 21 and according to FIG. 3 carries laterally longitudinal guides 13 for the heel jaw housing 16 which for this purpose carries lateral longitudinally extending guide projections 56 which engage from the inside into the longitudinal guides 13. The heel jaw housing 16 is mounted with vertical play 57 in the longitudinal guides 13. In addition, there is a certain lateral play of the heel jaw housing 16 in the longitudinal guides 13 which, just like the vertical play 57, can be cancelled by raising the heel jaw housing 16 relatively to the longitudinal guides 13 in the manner described in detail hereinafter.

Figure 5:
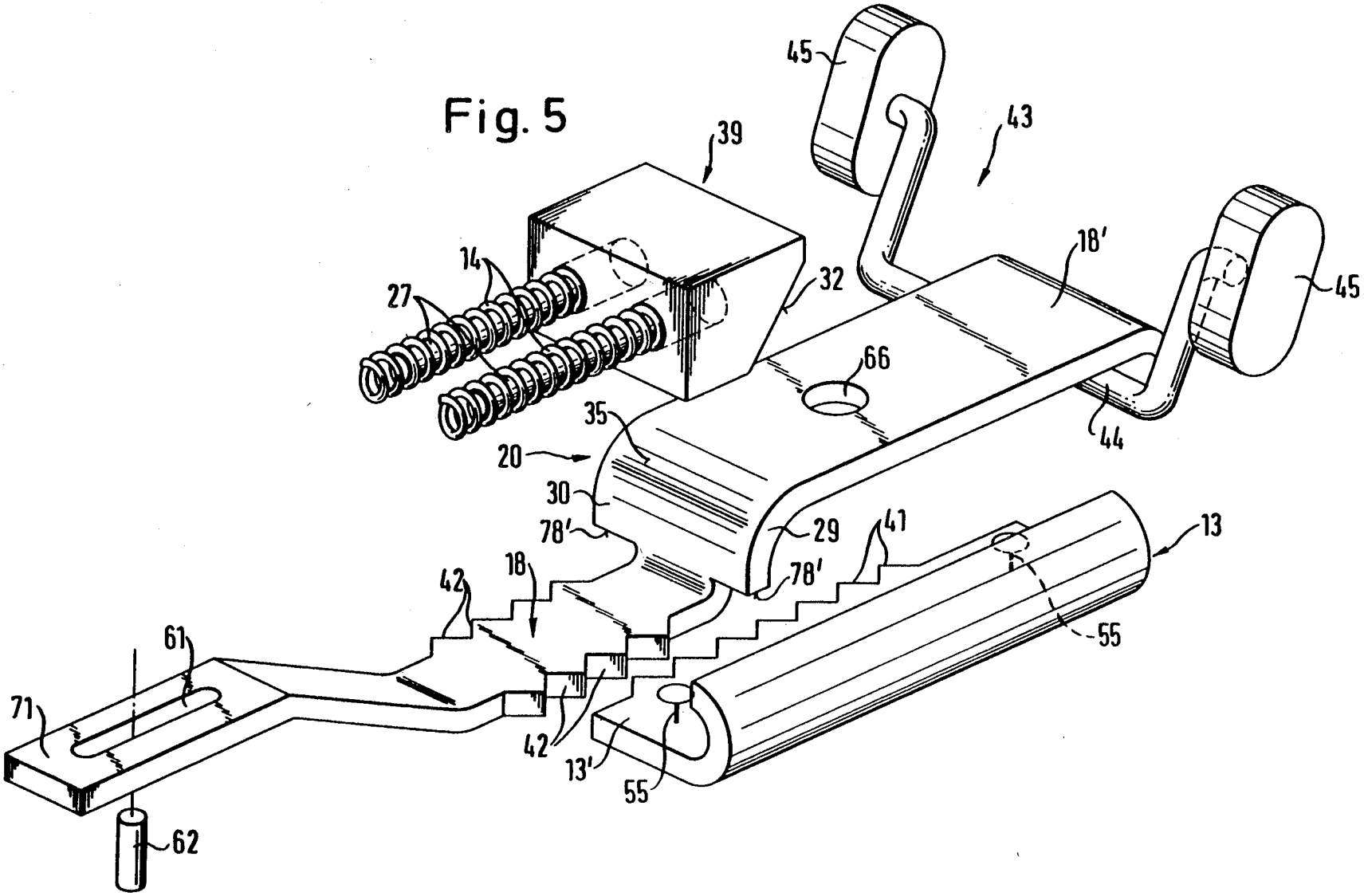
FIG. 5 shows a perspective and exploded view of the individual parts accommodated in the heel jaw housing according to FIG. 4.

Normally, the lock member 18 and the longitudinal guides 13 do not form a single component as illustrated in FIGS. 1 and 2 but, as will be shown below with reference to FIG. 5, are adjustable relatively to each other in the longitudinal direction. However, for simple illustration of the idea underlying the invention in the example of embodiment according to FIGS. 1 and 2 the lock member 18 and the longitudinal guides 13 are assumed to be in one piece. The securing means 55 thus serve both for fixing the lock member 18 and the longitudinal guides 13 to the ski 21.

At the lower side of the heel jaw housing 16 a cavity 38 is provided in which the thrust spring 14 is arranged which bears with its front end on an abutment surface 58 disposed perpendicularly to the longitudinal axis of the ski 21. The rear end of the thrust spring 14 acts on a spring abutment 33 which is formed on a guide rod 59 passing through the interior of the thrust spring 14 formed as helical spring.

The rod-like shaped input member 27 of a force-resolving means 20 according to the invention extends rearwardly from the abutment 33 and comprises at the top and bottom rearwardly tapering wedge faces 31, 32 cooperating with counter faces 34, 35 complementary thereto of spreading members 28, 29 extending upwardly and downwardly and formed as spreading pins. The spreading pins 28, 29 are arranged upwardly and downwardly displaceably in an output member 30 formed as slide and act on the heel jaw housing 16 from below and the lock member 18 from above. The output member 30 bears on its rear side on an upwardly directed angle portion 18" of the lock member 18 and is mounted at its upper side in a slide guide 60 of the heel jaw housing 16 for longitudinal displacement. In its front end region 71 mounted longitudinally displaceably in a housing slot 72 the lock member 18 comprises according to FIG. 2 a slot 61 into which a vertical pin 62 mounted on the heel jaw housing 16 engages. The slide guide 60 and the slot 61 are dimensioned relatively to each other in such a manner that the displacement range of the output member 30 along the slide guide 60 corresponds to the displacement range of the vertical pin 62 in the slot 61.

Figure 3:
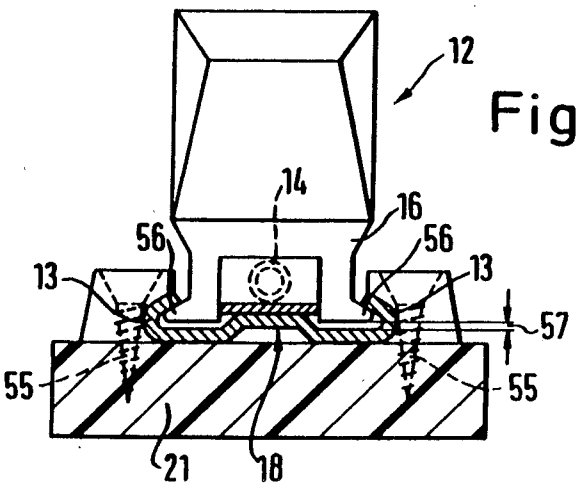
FIG. 3 is a partially sectioned view of the heel jaw according to FIG. 2 from the rear in the direction of the arrow III of FIG. 2.

If a ski boot is inserted into the binding comprising the heel jaw 12 according to FIGS. 2 and 3, because of the skifixed arrangement of the longitudinal guides 13 and the lock member 18 the heel jaw 16 is pushed rearwardly to a greater or lesser extent with compression of the spring 14. The spring 14 bears here via the abutment 33 and the input member 27 and via the wedge faces 31, 32, counter faces 34, 35 and the spreading pins 28, 29 on the output member 30 which in turn bears on the angle portion 18" of the lock member 18. To ensure the supporting via the spreading pins 28, 29 the play 57 shown in FIG. 2 and the slight lateral play are important.

Due to the wedge faces 31, 32 and the counter faces 34, 35 on this force transfer upwardly and downwardly directing spreading forces S are exerted simultaneously by the spreading pins 28, 29 from below on the binding housing 16 and from above on the lock member 18. These spreading forces S, derived from the longitudinal force F of the spring and thus proportional thereto, effect a raising of the binding housing 16 relatively to the longitudinal guides 13 into the position shown in FIG. 3, thereby firstly cancelling the play between the guide projections 56 and the longitudinal guides 13 and secondly simultaneously increasing the friction therebetween. The increase in friction by the spreading forces S is conveniently dimensioned according to the invention in such a manner that the increase of the thrust force P taking place on compression of the thrust spring 14 is at least substantially reduced, preferably however completely compensated.

The output member 30 and the angle 18" of the lock member 18 may form a single component and likewise one of the spreading pins 28 or 29 could be integrated into the output member 30; the output member 30 would however then have to have adequate lateral play relative to the input member 27 to ensure the necessary clamping of the binding housing 16 in the longitudinal guides 13.

Whereas the example of embodiment according to FIGS. 2 and 3 is intended primarily to explain the principle of the present invention, the following Figures, in which identical reference numerals refer to corresponding parts to those in FIGS. 1 to 3, illustrate particularly preferred constructional implementations of the idea underlying the invention.

Figure 4:
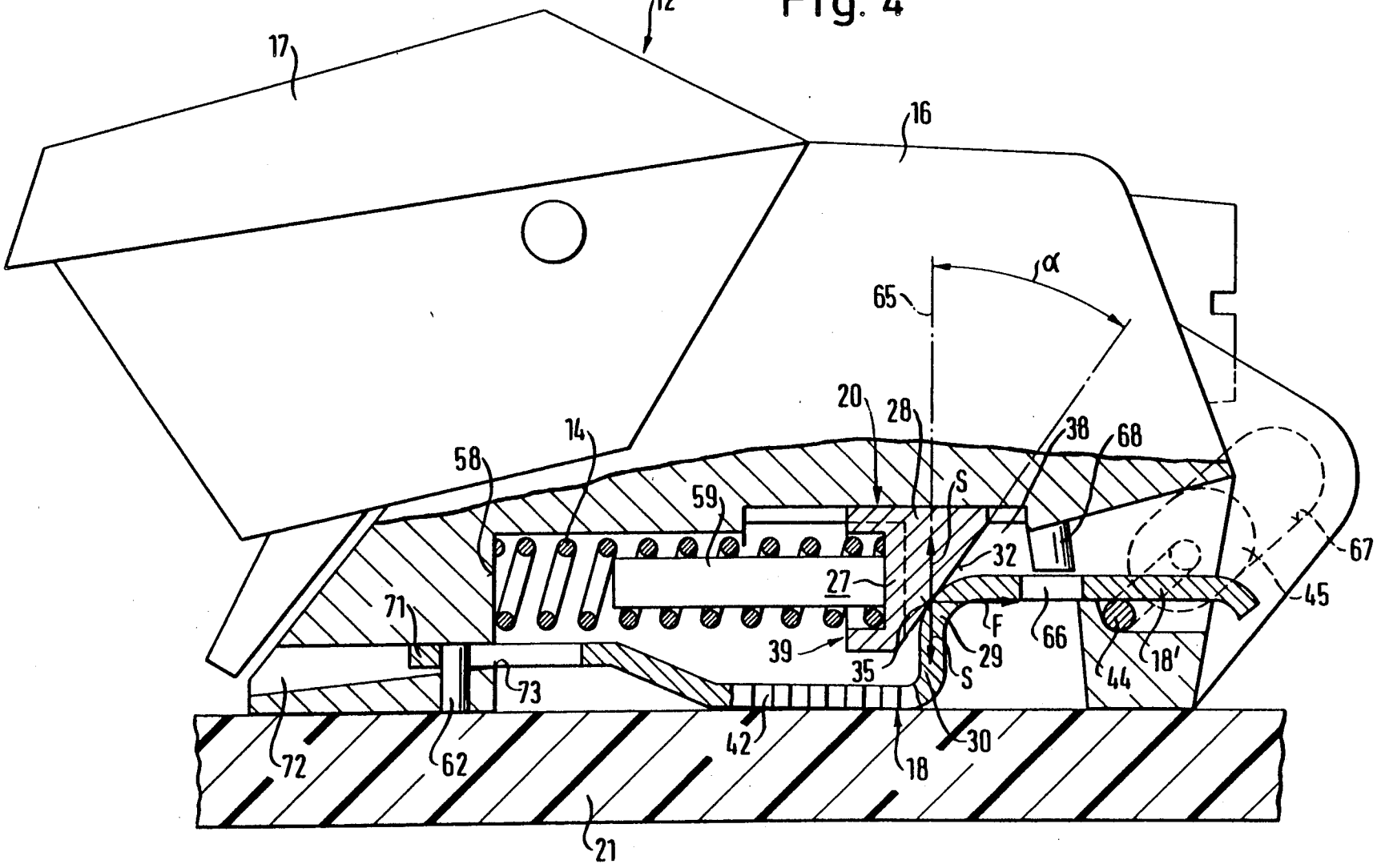
FIG. 4 is a partially sectioned side view of a further embodiment of a heel jaw according to the invention in the rest position with the ski boot not inserted.

In accordance with FIG. 4, at the front of the binding housing 16 a sole holder 17 is provided which is pivotal upwardly against a release force and which represents a safety holder for the rear end of the ski boot. The input member 27 of the force-resolving means 20 simultaneously forms the rear abutment of the thrust spring 14. The input member 27 is further part of a piston 39 into which in addition the upper spreading member 28 acting from below on the heel jaw housing 16 is integrated. Said spreading member comprises a rear wedge face 32 which slopes from the top rear to the bottom front and which forms an angle $\alpha$ with the vertical 65.

This inclined wedge face 32 bears on a complementary infinitesimal counter face 35 of the arcuately formed spreading member 29 which is fixedly connected via the vertically extending output member 30 to the lock member 18 again secured to the ski 21. In this manner, on the one hand the rear end of the thrust spring 14 bears on the lock member 18. Simultaneously however, the longitudinal force F of the thrust spring 14 generates via the faces 32, 35 the oppositely directed spreading forces S which simultaneously press the piston 39 from below upwardly against the heel jaw housing 16 and the lock member 18 downwardly against the ski 21.

FIG. 5 shows that instead of a thrust spring two thrust springs 14 may also be arranged adjacent each other and act on the piston 39. FIG. 5 also shows how the lock member 18 can be secured to the ski or the longitudinal guides 13 adjustably in the longitudinal direction of the ski by means of tooth means 41, 42.

The longitudinal guides 13 are attached firmly to the ski 21 by securing means 55 which are only schematically indicated. On the inside the lower legs 13' of the longitudinal guides 13 are provided with a longitudinal toothing 41 into which from above toothings 42 of the lock member 18 complementary thereto can engage. Depending on the direction in which the toothings 41, 42 come into engagement, the lock member 18 and thus also the heel jaw 12 are in a correspondigny different longitudinal position on the ski 21. In this manner a heel jaw 12 can be adapted to a specific ski boot size.

According to the invention the lock member 18 is pressed via the force-resolving means 20 downwardly into the toothing 41 of the longitudinal guides 13. The downwardly directed spreading force S (FIG. 4) thus additionally ensures a reliable locking of the lock member 18 in the longitudinal guides 13, providing however at the same time a desired releasability.

To release the gauged toothings 41, 42 from each other the lock member 18 comprises following the output portion 30 and the spreading portion 29 a horizontal rearwardly directed extension 18' which has a vertical bore 66 and beneath the rear region of which a stop rod 44 engages. The stop rod 44 is provided with lateral grips 45 which are arranged displaceable inclined rearwardly and upwardly in inclined guides 67 of the heel jaw housing 16 indicated in dashed line in FIG. 4.

In the rest position of the heel jaw 12 shown in FIG. 4 above the bore 66 there is a pin 68 which extends downwardly from the binding housing 16 but in the rest position is out of engagement with the bore 66.

Figure 7:
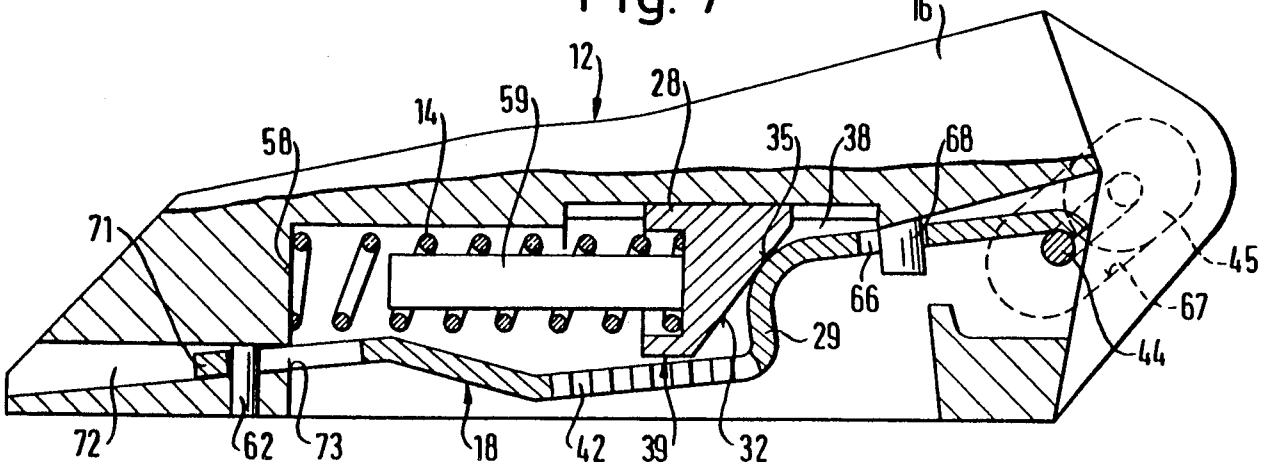
FIG. 7 is a side view analogous to FIG. 6 with the lock member raised for longitudinal displacement of the heel jaw, the heel jaw housing being in the rest position with the ski boot not inserted.

However, if in accordance with FIG. 7 the two grips 45 are gripped in the position according to FIG. 4 and shifted within the inclined guides 67 the lock member 18 is raised and the stud 68 comes into engagement with the bore 66, leading to a longitudinal locking between the lock member 18 and the binding housing 16. This engagement must be established before the toothings 41, 42 are detached from each other.

To enable the lock member 18 to execute the upward pivotal movement the front end region 71 (FIG. 4) thereof is mounted in a forwardly open slot 72 of the heel jaw housing 16. In this manner, at the rear end of the forwardly widening slot 72 a transverse axis 73 is formed about which the lock member 18 can pivot on lifting.

After lifting the lock member 18 out of the toothing 41 (FIG. 7), by likewise exerting a force on the grips 45 the heel jaw 12 can be pushed with the lock member 18 in the longitudinal direction of the ski into the desired position. If the grips 45 are then released in this position, due to the action of the thrust spring 14 the piston 39 again urges the lock member 18 automatically downwardly into engagement with the toothings 41 of the longitudinal guides 13. As this happens, the stud 68 and the bore 66 come out of engagement again and the binding is ready for operation in the new adjustment position.

Figure 6:
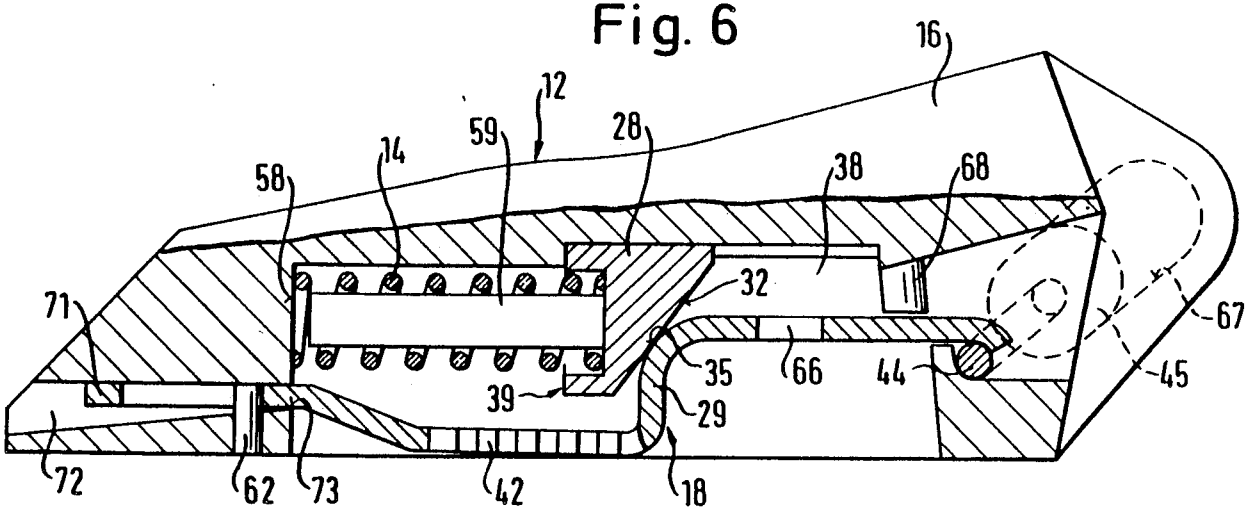
FIG. 6 is a view analogous to FIG. 4 but showing the furthest retracted position of the heel jaw housing.

FIG. 6 shows the heel jaw 12 in the position pushed furthest to the rear where the thrust spring 14 is compressed greatest.

Figure 8:
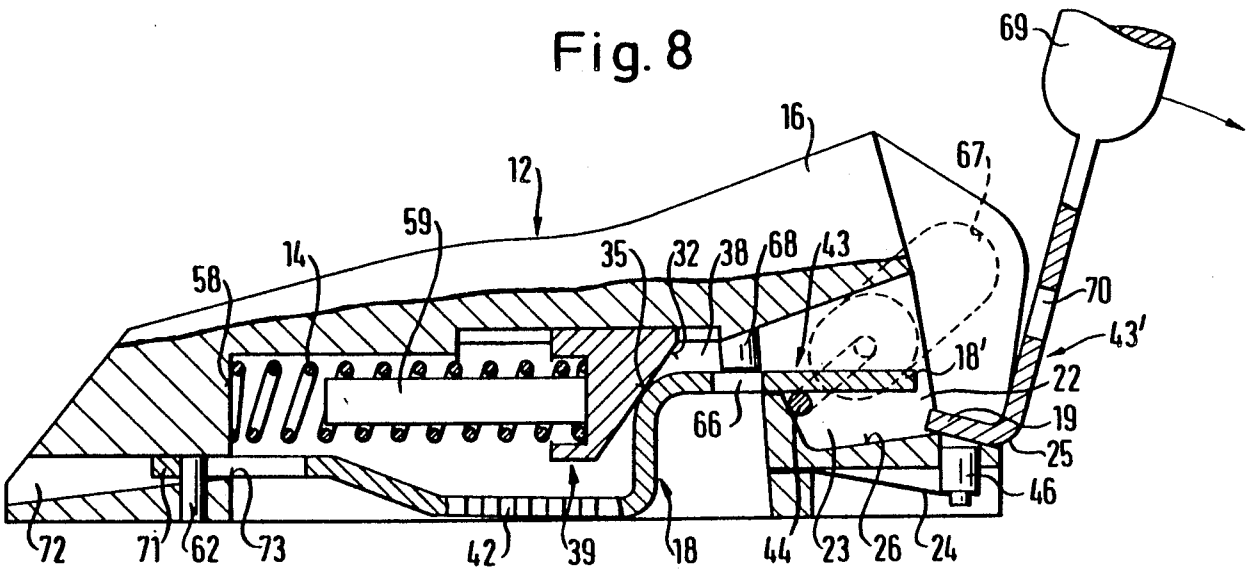
FIGS. 8 and 9 show a sectioned side view analogous to FIGS. 6 and 7, the release by means of an angled tool being demonstrated.
Figure 9:
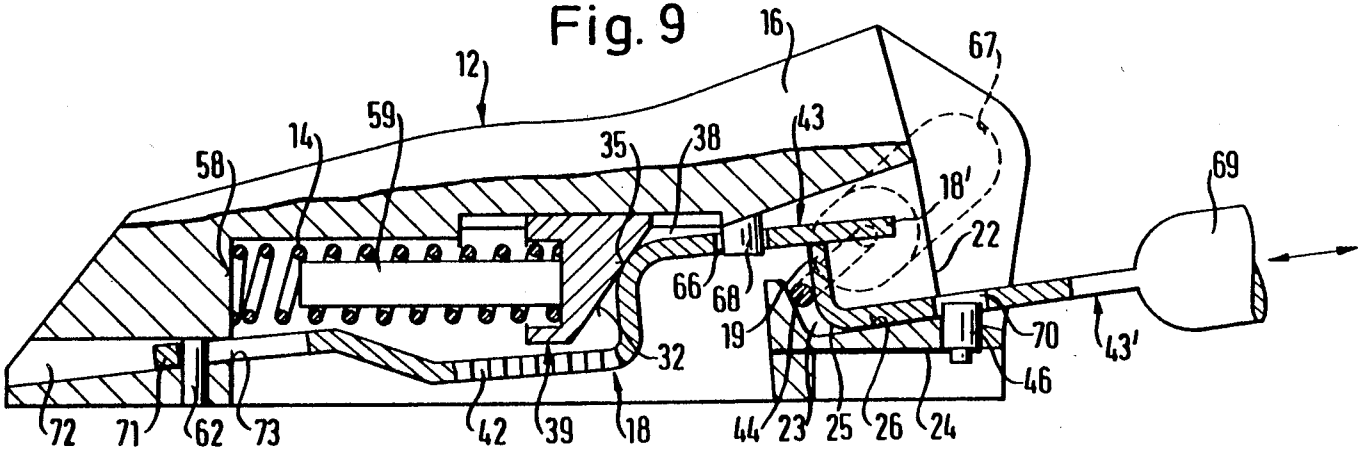

In accordance with FIGS. 8 and 9, in addition to the actuating member 43 fixedly integrated in the heel jaw 12 or instead of said member an actuating member 43' formed as special tool may be provided for facilitating adjustment of the heel jaw 12 in the longitudinal direction of the ski.

The actuating member 43' representing a tool has an angled front end 19 adapted to be introduced through a rear opening 22 in the binding housing into a cavity 23 provided beneath the extension 18', first pressing a longitudinal entraining pin 46 provided movable up and down at the bottom in the heel jaw housing 16 downwardly against the force of a leaf spring 24. When the angle edge 25 of the actuating member 43' has engaged a forwardly sloping inclined face 26 provided at the lower border of the cavity 23, by exerting a force on the grip 69 of the actuating member 43' in the sense of the arrow in FIG. 8 the lock member 18 can be raised for disengaging the toothings 41, 42 (FIG. 5) from each other, the stud 68 again coming into locking engagement with the bore 66.

As soon as the actuating member 43', in accordance with FIG. 9, has pivoted downwardly to such an extent that the lock member 18 is in its uppermost position the longitudinal entraining pin 46 snaps into a bore 70 provided in the actuating member 43' so that now a form-locking connection exists between the actuating member 43' and heel jaw housing 16 and by exerting forces in the sense of the double arrow in FIG. 9 on the grip 69 longitudinal forces can also be exerted on the heel jaw 12. In the raised position of the lock member 18 longitudinal adjustment of the heel jaw 12 can thus easily be carried out for adaptation to a specific ski boot size.

Figure 10:
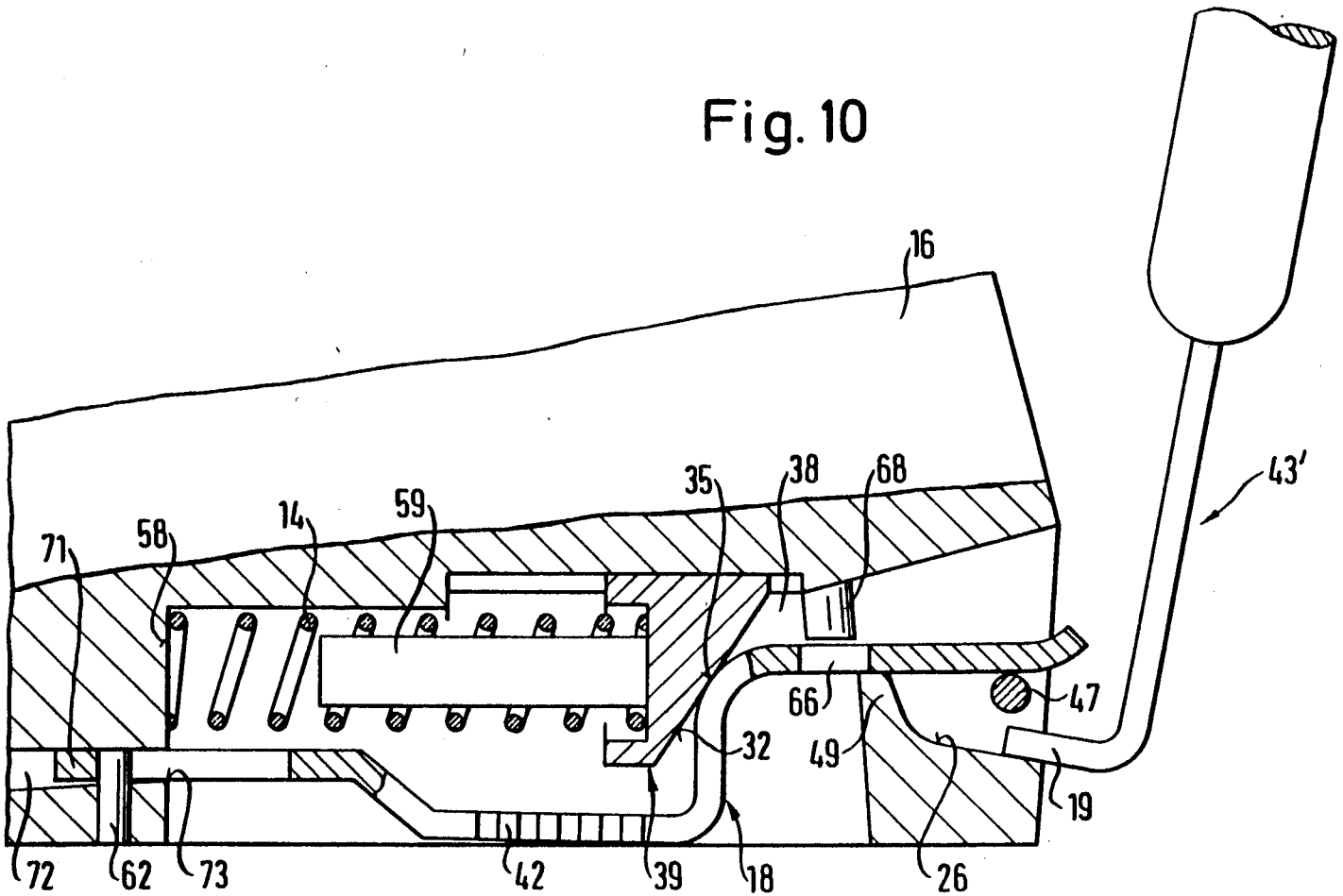
FIGS. 10 and 11 show side views analogous to FIGS. 6 and 7 but indicating the adjustment of the heel jaw by means of an angled tool with a somewhat different construction than in FIGS. 8 and 9.
Figure 11:
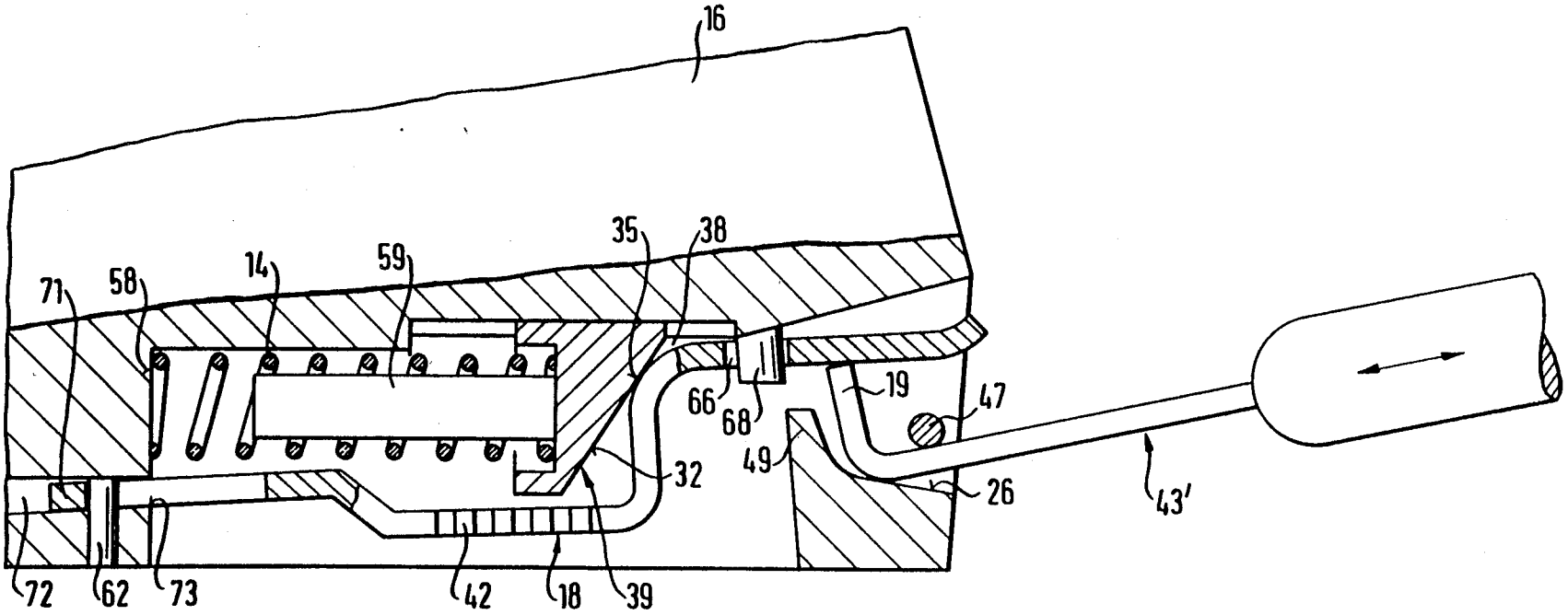

According to FIGS. 10 and 11 the actuating member 43 integrated fixedly into the binding housing 16 according to FIGS. 4 to 9 has been dispensed with. Instead of the longitudinal entraining pin 46 according to FIGS. 8, 9, in a rear cavity 74 of the binding housing 16 spaced from the lower boundary face 26 thereof there is a fixed transverse pin 47 beneath which the tool-like actuating member 43' can engage for raising the lock member 18 into the adjusting position in a manner similar to FIGS. 8 and 9. In the lifted-out position according to FIG. 11 adjusting forces can now be exerted in the direction of the double arrow on the actuating member 43' and can be transmitted either via the transverse pin 47 or a front counter stop 49 on the binding housing 16 to said housing, thereby permitting the desired longitudinal adjustment.

The angled end 19 of the actuating member 43' thus serves not only for raising the lock member 18 but at the same time also for longitudinal adjustment of the binding housing 16.

Figure 12:
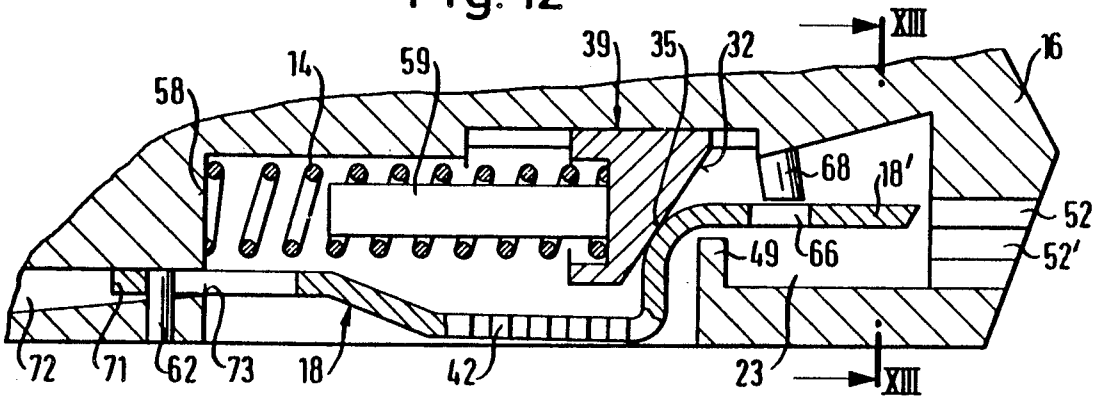
FIG. 12 shows a partially sectioned side view similar to FIG. 6 but for adjusting a specific opening in the rear wall of the heel jaw housing.
Figure 13:
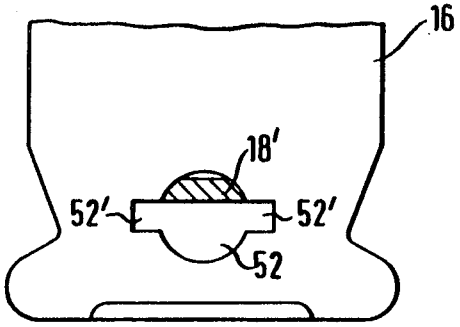
FIG. 13 is a section along the line XV—XV of FIG. 12.

According to FIGS. 12 and 13, in the rear lower region of the heel jaw housing 16 an opening 52 formed according to FIG. 13 may also be provided which is round in the centre and has two lateral projections 52'. Cooperating with said opening 52 is a screwdriver-like actuating member 43" according to FIGS. 14 and 15, for which it is important that in the region of the front end lateral projections 51 are provided on the shank of the actuating member 43" and fit into the lateral recesses 52' of the opening 52.

Figure 14:
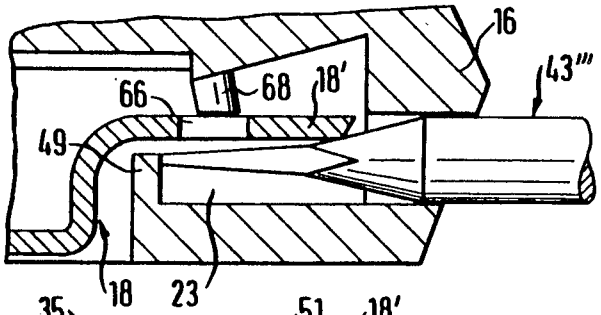
FIGS. 14 and 15 show partial and complete views respectively analogous to FIG. 14, the screwdriver-like actuating member according to FIGS. 14, 15 being shown in two different turning positions within the heel jaw housing.

In this manner the actuating member 43'" can be inserted with its front end in the position shown in FIG. 13 from the rear into the opening 52 of the binding housing 16, the projections 51 thereby moving into the cavity 23 and the actuating member 43" coming to bear with its front end on a counter stop 49 (FIG. 14).

Figure 15:
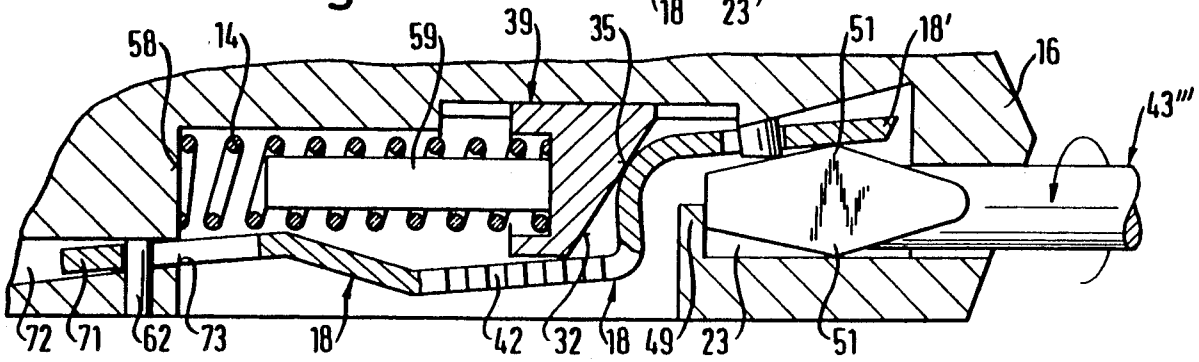

If the actuating member 43'" is now turned out of the position according to FIG. 14 through 90° into the position according to FIG. 14 and 15, in the course of the rotational movement the projections 51 bear on the bottom of the binding housing 16 or on the extension 18' so that the latter is raised and the lock member 18 thereby brought out of engagement with the toothing 42 (FIG. 5).

Due to the specific form of the opening 52 a pulling on the actuating member 43'" rearwardly now leads to a force transmission to the binding housing 16 rearwardly whilst on knocking the actuating member 43" forwardly a force is exerted forwardly via the counter stop 49.

Thus, with the embodiment according to FIGS. 12 to 15 a particularly simple and effective adjustment of the heel jaw can be effected.

The embodiment according to FIGS. 16 to 19 differs from that according to FIGS. 4 to 17 in that a force-resolving means 20' operating with a lever mechanism is employed. As apparent in particular from FIGS. 16 and 17, the input portion 27 on which the rear end of the thrust spring 14 acts is a lever arm which is articulately connected via a transverse pin 40 disposed beneath the centre axis of the thrust spring 14 to the upper spreading member 28 which is formed as sleeve-like slide which is arranged in the lower cavity 38 of the heel jaw housing 16 for longitudinal displacement relatively to the latter. The angle slot 75 according to FIG. 17 serves only to bring the transverse pin 40 into the operating position shown in FIG. 16. Between the input portion 27 and a stop 76 provided in the rear region of the spreading member 28 in accordance with FIG. 18 a pronounced play 77 must remain.

Figure 17:
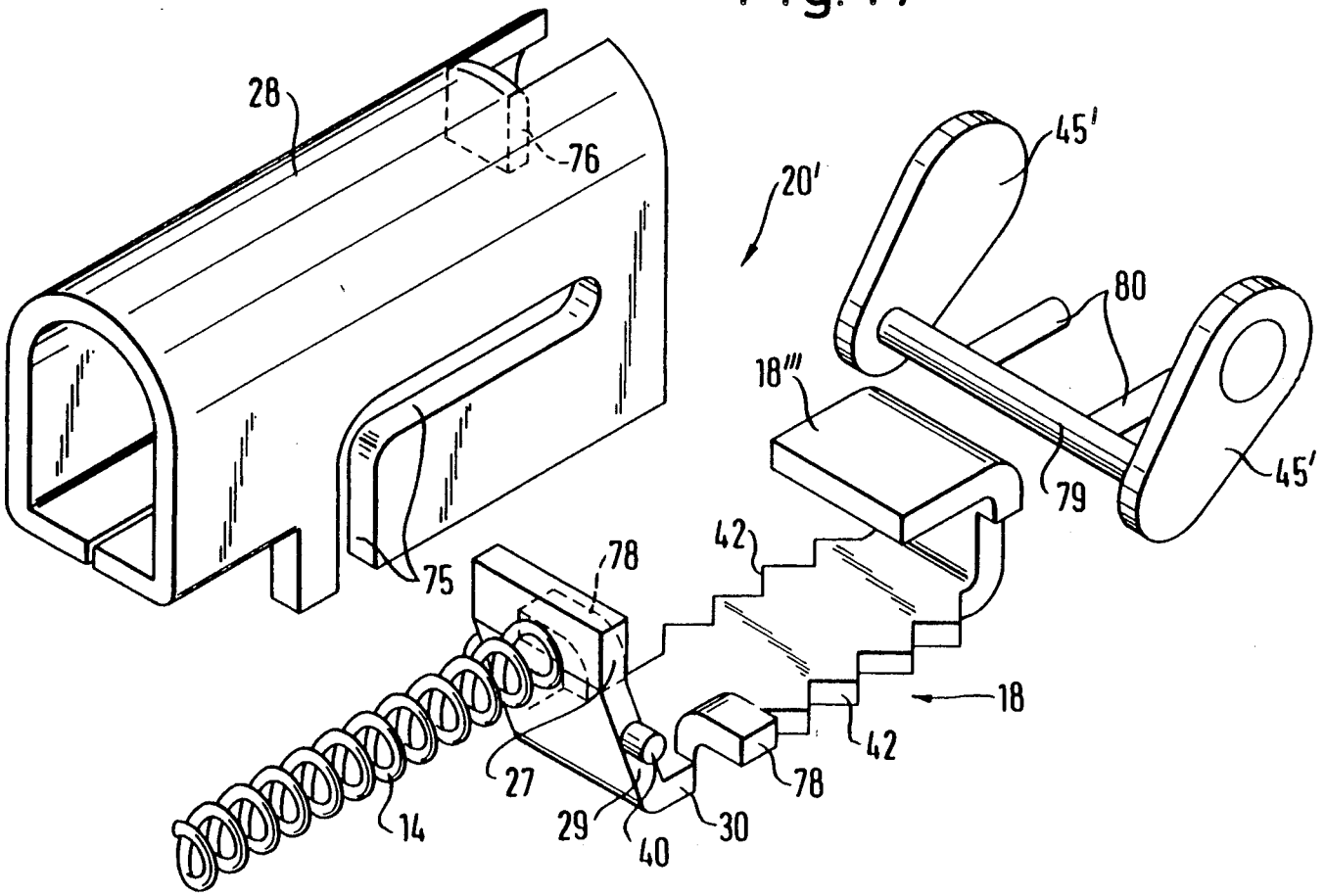
FIG. 17 is a perspective exploded view of the components arranged beneath the heel jaw housing according to FIG. 18.

On the other side of the transverse pin 40 the input portion 27 formed as lever arm merges into the lower spreading member or portion 29 likewise formed as lever arm and via the output portion 30 integral with the spreading member 29 the connection to the lock member 18 again lying on the ski 21 is established, said lock member coming into engagement by means of lateral toothings 42 in a manner analogous to FIG. 5 with the complementary toothings 41 of the longitudinal guides 13 not illustrated in FIG. 17. Lateral projections 78 bear from above on the legs of the longitudinal guides 13 (FIG. 5) carrying the toothings 41 to ensure a supporting directly from above as well on the longitudinal guides 13.

For the same purpose the output portion 30 according to FIG. 5 may be extended laterally at 78' so that in this example as well it is ensured that the lock member 18 is supported from above on the legs of the longitudinal guides 13 carrying the toothing 41.

An angle extension 18'" projecting upwardly from the rear end of the lock member 18 serves for manual actuation by means of grips 45' which are rotatably mounted within a limited pivot range ($\beta$ in FIG. 19) via a pivot pin 79 connecting them in the binding housing 16. Stop arms projecting rearwardly from the pivot pins 79 engage beneath the angled extension 18'" according to FIG. 19.

Figure 16:
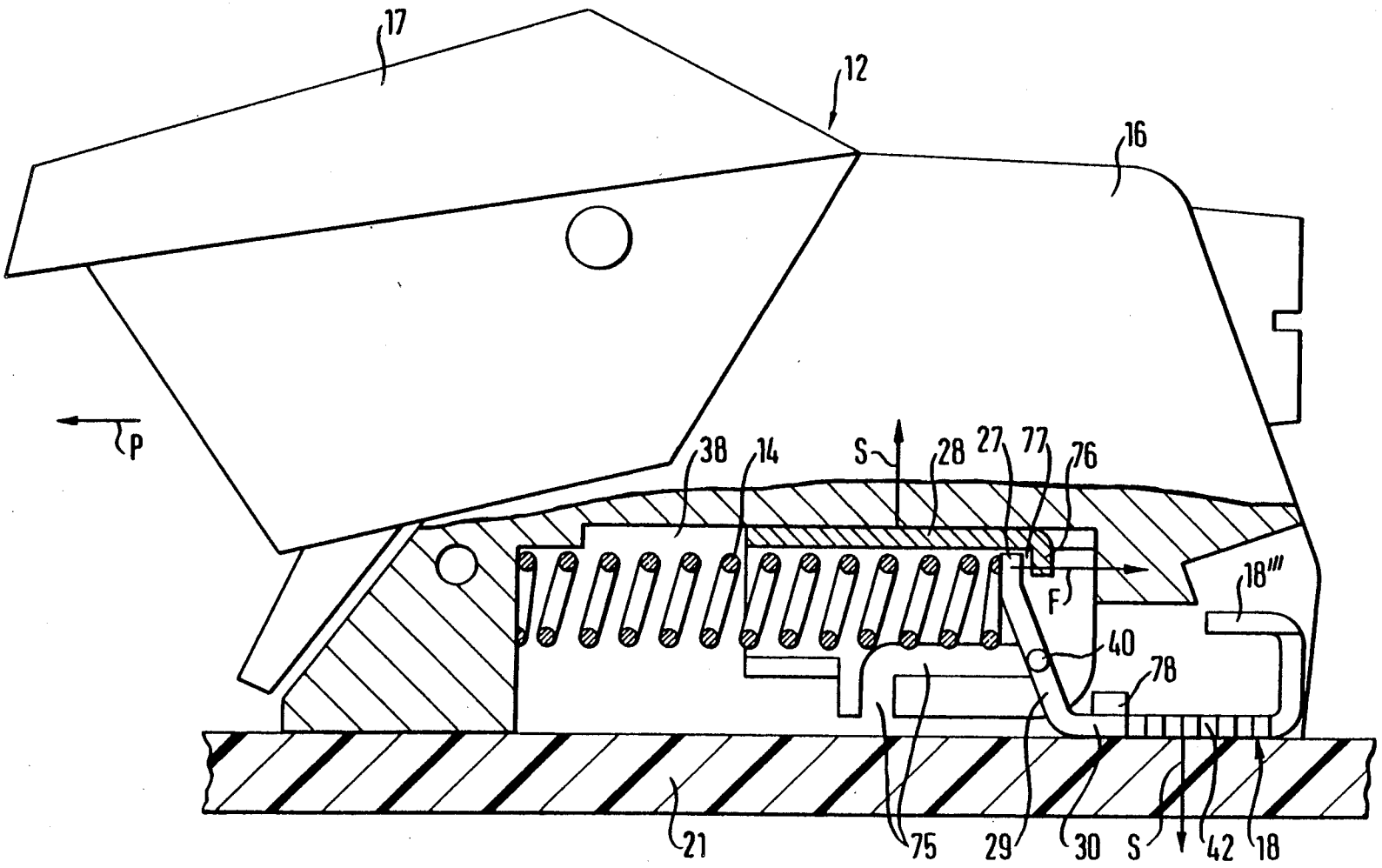
FIG. 16 is a partially sectioned side view of a third embodiment of a heel jaw according to the invention in the rest position with the ski boot not inserted.

The longitudinal force F of the thrust spring 14 acts in accordance with FIG. 16 on the input portion 27 formed as lever arm and thereby exerts a turning moment clockwise about the transverse axis 40. This turning moment leads at the lock member 18 to a downwardly directed spreading force S and at the spreading portion 28 bearing from below on the binding housing 16 to an upwardly directed spreading force S so that once again vertical clamping is effected between the binding housing 16 and the longitudinal guides 13 analogous to FIG. 3.

Figure 18:
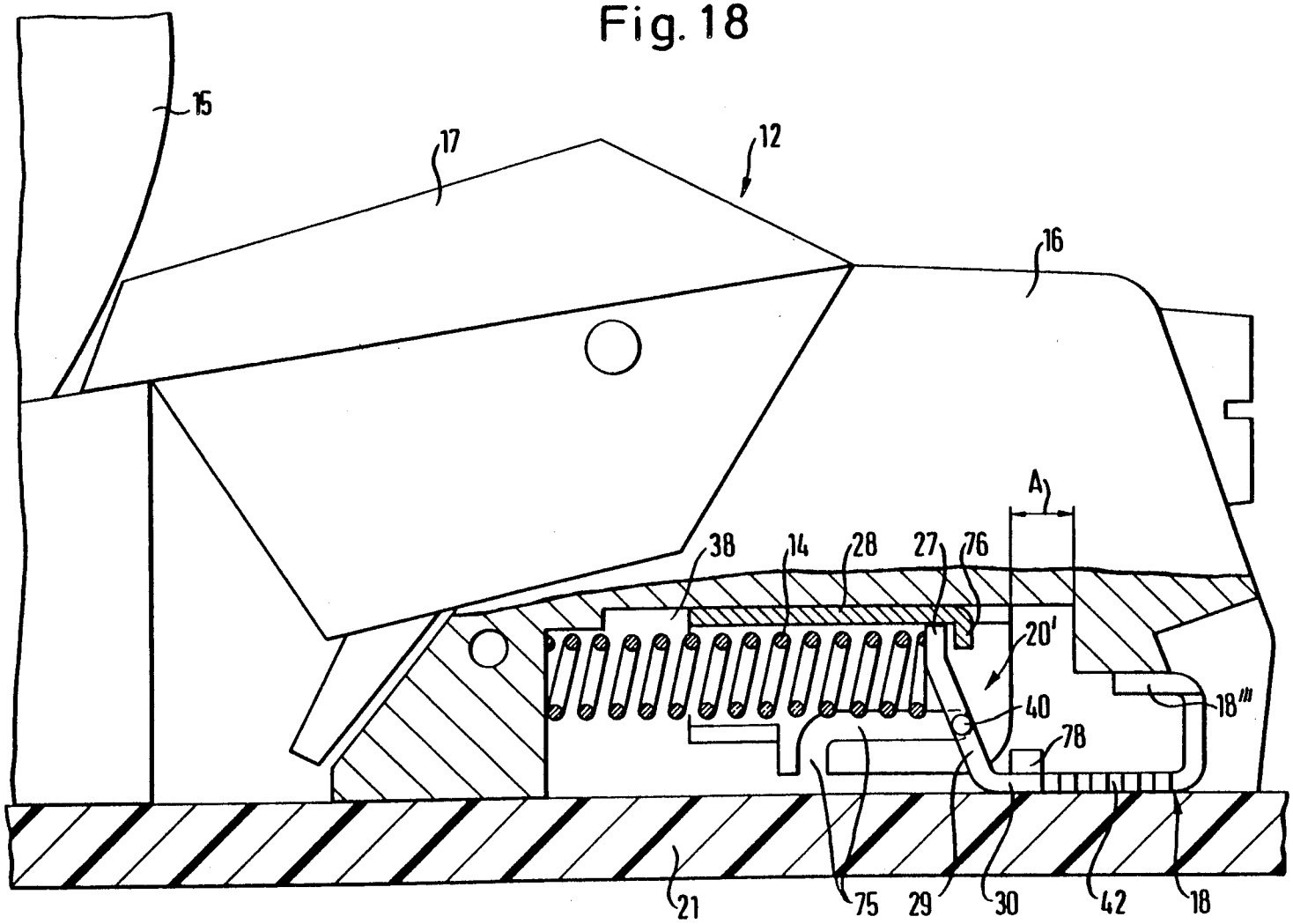
FIG. 18 is a partially sectioned side view analogous to FIG. 18 in the operating position of the heel jaw with the ski boot inserted.

FIG. 18 shows this embodiment of the heel jaw according to the invention with the ski boot 15 inserted, the heel jaw housing 16 being rearwardly displaced a distance A relatively to the fixed spreading member 28.

Figure 19:
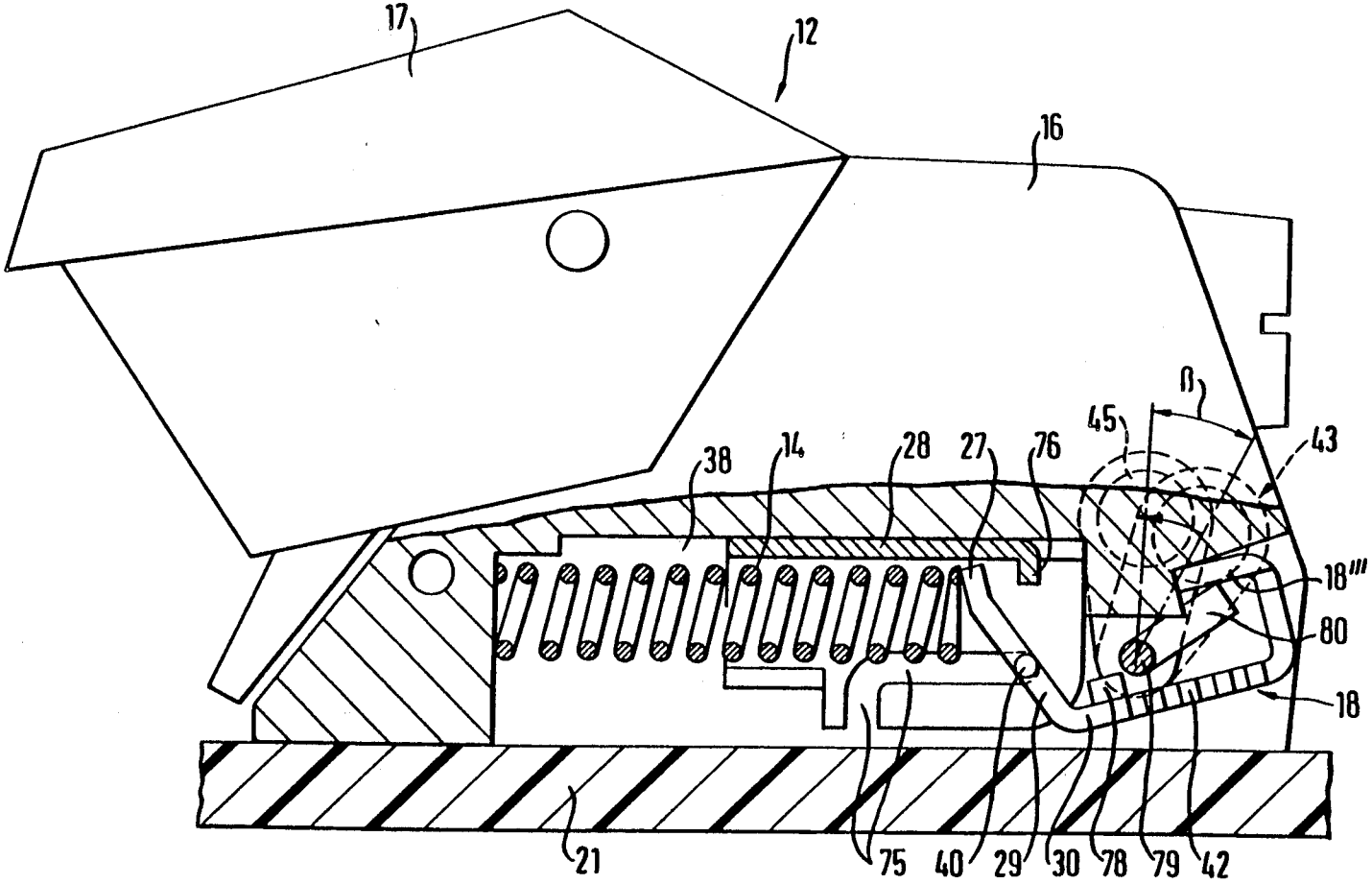
FIG. 19 is a side view analogous to FIG. 18 in the rest position with the ski boot not inserted and with the actuating member pivoted for longitudinal adjustment of the heel jaw.

If a longitudinal adjustment of the heel jaw 12 is to be made then with the ski boot not inserted the grips 45' are pivoted forwardly in the direction of the arrow according to FIG. 19, the stops 80 thereby lifting the angled extension 18" and thus pivoting the lock member 18 upwardly about the transverse pin 40, the thrust spring 14 being slightly compressed via the input portion 27 so that a corresponding return force is present.

I claim:

1. A safety ski binding for a ski comprising:

a releasable holding jaw having a front jaw for engaging one end of a ski boot and a heel jaw housing for engaging a second end of the ski boot and for urging the ski boot against said front jaw with a thrust force (P);

a pair of longitudinal guides fixedly attached to the ski; said heel jaw housing mounted with vertical and horizontal play in said longitudinal guides so that said heel jaw housing is longitudinally displaceable;

an adjustable lock member having means for affixing said lock member to said pair of longitudinal guides;

a longitudinally disposed thrust spring having a first end bearing on said heel jaw housing;

a force-resolving means for limiting an increase in thrust force (P) in response to an increase in longitudinal force (F) of said thrust spring as a result of increasing compression of said spring; said force-resolving means being disposed between a second end of said thrust spring and said lock member; said force-resolving means being adapted for distributing a part of the longitudinal force (F) of said thrust spring into substantially downwardly and upwardly directed spreading forces (S) acting on said lock member in the direction of the ski and on said heel jaw housing in the direction away from the ski, respectively, thereby progressively increasing the frictional forces between said jaw housing and said guides as a result of increasing compression of said thrust spring.

2. The safety ski binding of claim 1 wherein said force-resolving means comprises an input member having a first spreading member and a second spreading member integrated as an element of an output member and wherein said output member has transverse play relative to said input member such that substantially opposite and equal spreading forces (S) can be transmitted by said output member and said first spreading member to said lock member and to said heel jaw housing.

3. The safety ski binding of claim 2 wherein said input member comprises a piston disposed between the second end of said spring and said lock member and longitudinally displaceable in a lower cavity of said heel jaw housing; said piston integrated with said upper spreading means so that said spreading forces (S) act from below on said heel jaw housing; said piston having a wedge face remote from said thrust spring which acts on a corresponding counterface of said lower spreading member integrated with said output member into said lock member so that said spreading forces act from above on said ski.

4. The safety ski binding of claim 1 further comprising:

toothing means for affixing said lock member to said ski; said toothing means having a lower toothing portion affixed to said ski and a complementary upper toothing portion attached to said lock member so that by raising the upper toothing portion, said toothing means can be brought out of engagement thereby enabling longitudinal movement of said lock member and said heel jaw housing relative to said ski;

means for engaging said lock member and said heel jaw housing; and an actuating member for raising said lock member with slight compression of said thrust spring via said force resolving means thereby raising said upper toothing portion out of engagement with said lower toothing portion; said actuating member adapted to come into engagement with said heel jaw.

5. The safety ski binding according to claim 4 further comprising a stop which engages from below an extension of said lock member and which connects to grips disposed in inclined guides in said heel jaw housing; said lock member pivotal about a transverse axis disposed at the rear end of a forwardly widening slot of said heel jaw housing; and wherein said actuating member comprises an angular tool for engaging an extension of said lock member and thereby either first presses downwardly a resiliently upwardly urged longitudinal entraining pin 46 and then allows said pin to drop into a longitudinal entraining opening 70 or at the same time with its angled portion 19 engages behind a fixed transverse pin 47 provided in the heel jaw housing.

6. The safety ski binding of claim 4 wherein a screwdriver-like actuating member having at least one lateral projection in its front region is introducible into said heel jaw from behind through a complementary opening in said heel jaw housing so that by rotating said actuating member and upwardly raising said lock member adjusting forces can be transmitted to said heel jaw housing and said lock member.

7. The safety ski binding of claim 1 wherein said force-resolving means comprises an input member acted upon by said thrust spring; said input member longitudinally moveable with the end of said thrust spring; an upper and a lower transversely moveable spreading member acted upon by said spreading forces (S); said upper and lower spreading forces having substantially equal magnitude; and an output member bearing on said lock member acted upon by at least one of said spreading members in a direction away from the thrust spring.

8. The safety ski binding of claim 7 wherein said input member comprises an extension of a spring abutment acted upon by said thrust spring; said input member having two diametrically opposite wedge faces for acting upon corresponding counterfaces of said spreading members so as to partially resolve said longitudinal force (F) into said spreading forces (S); at least one of said spreading members transversely displaceable in said output member so that said spreading members transmit the longitudinal force (F) exerted by said thrust spring via the output member to said lock member; said output member being slidable in a slide guide of said heel jaw housing.

9. The safety ski binding of claim 7 wherein:

said upper spreading member further comprises a sleevelike slide disposed in a cavity of said heel jaw housing; said upper spreading member having a stop and an angle slot; and said input member further comprises a lever arm adapted to receive said longitudinal force (F) of said thrust spring and a transverse pin for transfer of a component of said longitudinal force (F) to said upper spreading member; said lever arm merging into said lower spreading member for transfer of a component of said longitudinal force (F) to said lower spreading member.

10. A safety ski binding adapted for receiving a ski boot comprising:

a pair of longitudinal guides fixedly attached to a ski and provided with toothing elements;

releasable holding means having a front jaw for engaging one end of said ski boot and a heel jaw housing for engaging a second end of said ski boot; said heel jaw housing mounted with horizontal and vertical play in said guides and adapted for longitudinal displacement with respect to said guides;

an adjustable lock member provided with complementary toothing elements for attaching said lock member to said guides;

a thrust spring for urging said heel jaw housing against the ski boot;

means for eliminating said play and for limiting the rise of thrust force with a ski boot inserted in said safety binding upon increasing compression of said thrust spring said means including means for directing an upward force against said heel jaw housing and a downward force against said lock member.

* * * * *